US005431108A

United States Patent [19]

Theurer et al.

[11] Patent Number: 5,431,108

[45] Date of Patent: Jul. 11, 1995

[54] CAR FOR TRANSPORTING AN ASSEMBLED TRACK SWITCH USING MULTIPLE SUPPORT PLATFORMS

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 217,431

[22] Filed: Mar. 24, 1994

[30] Foreign Application Priority Data

Mar. 26, 1993 [DE] Germany ..... 9304617 U

[51] Int. Cl.[6] ..... E01B 29/02

[52] U.S. Cl. ..... 104/3; 410/31; 414/350

[58] Field of Search ..... 104/3; 105/355; 410/2, 410/31, 96; 414/350, 469

[56] References Cited

U.S. PATENT DOCUMENTS 1,994,717 3/1935 Kopke et al. ..... 104/3
4,627,359 12/1986 Buhler ..... 104/3

FOREIGN PATENT DOCUMENTS 160898 11/1985 European Pat. Off. ..... 104/3
0486456 5/1992 European Pat. Off. .
2314299 1/1977 France .

*Primary Examiner*—Robert J. Oberleitner
*Assistant Examiner*—S. Joseph Morano
*Attorney, Agent, or Firm*—Collard & Roe

[57] ABSTRACT

A car for transporting a track switch comprises a beam-shaped frame, undercarriages supporting the beam-shaped frame on track rails, the undercarriages having axles extending perpendicularly to the longitudinal direction and the beam-shaped frame being centered with respect to the axles. At least two track switch loading platforms are mounted on the beam-shaped frame for pivoting about an axis extending in the longitudinal direction, the loading platforms being spaced from each other in the longitudinal direction. At least two drives link each loading platform to the beam-shaped frame for pivoting the loading platform, and fastening elements are provided for detachably connecting a track switch to the loading platforms for transporting the track switch.

8 Claims, 2 Drawing Sheets

CAR FOR TRANSPORTING AN ASSEMBLED TRACK SWITCH USING MULTIPLE SUPPORT PLATFORMS

BACKGROUND OF THE INVENTION

1. Field of the Invention

The present invention relates to a car for transporting a track switch, which comprises a beam-shaped frame extending in a longitudinal direction, undercarriages supporting the beam-shaped frame on track rails, the undercarriages having axles extending perpendicularly to the longitudinal direction and the beam-shaped frame being centered with respect to the axles. A track switch loading platform is mounted on the beam-shaped frame for pivoting about an axis extending in the longitudinal direction, and drive means link the loading platform to the beam-shaped frame for pivoting the loading platform. A track switch may be detachably connected to the loading platform for transporting the track switch.

2. Description of the Prior Art

Such a car with a single loading platform for transporting a track switch has been disclosed in published European patent application No. 0 486 456. Published French patent application No. 2,314,299 also discloses a car for transporting a track switch but, instead of providing a loading platform for the track switch, this car has pivoting devices spaced from each other in the longitudinal direction of the car.

SUMMARY OF THE INVENTION

It is the primary object of this invention to improve a car of the first-described type with a structurally simplified loading platform arrangement for carrying the track switch.

The above and other objects are accomplished according to the invention by mounting at least two track switch loading platforms on the beam-shaped frame for pivoting about an axis extending in the longitudinal direction, the loading platforms being spaced from each other in said direction, and linking each loading platform to the beam-shaped frame by at least two drives for pivoting the loading platform. Means is provided for detachably connecting a track switch to the loading platforms for transporting the track switch.

The arrangement of several spaced-apart, independent loading platforms has the advantage that the uneven distribution of the mass due to the asymmetry of the track switch to be transported, which results in bending and torsional stresses in the loading platform, is substantially reduced. In addition, each loading platform may be less massive.

Preferably, the car comprises four track switch loading platforms. If a relatively short track switch section is to be transported, a loading platform at the end of the car need not be utilized.

BRIEF DESCRIPTION OF THE DRAWING

The above and other objects, advantages and features of the present invention will become more apparent from the following detailed description of a now preferred embodiment thereof, taken in conjunction with the accompanying, partly schematic drawing wherein.

DETAILED DESCRIPTION OF THE PREFERRED EMBODIMENT

Figure 1:
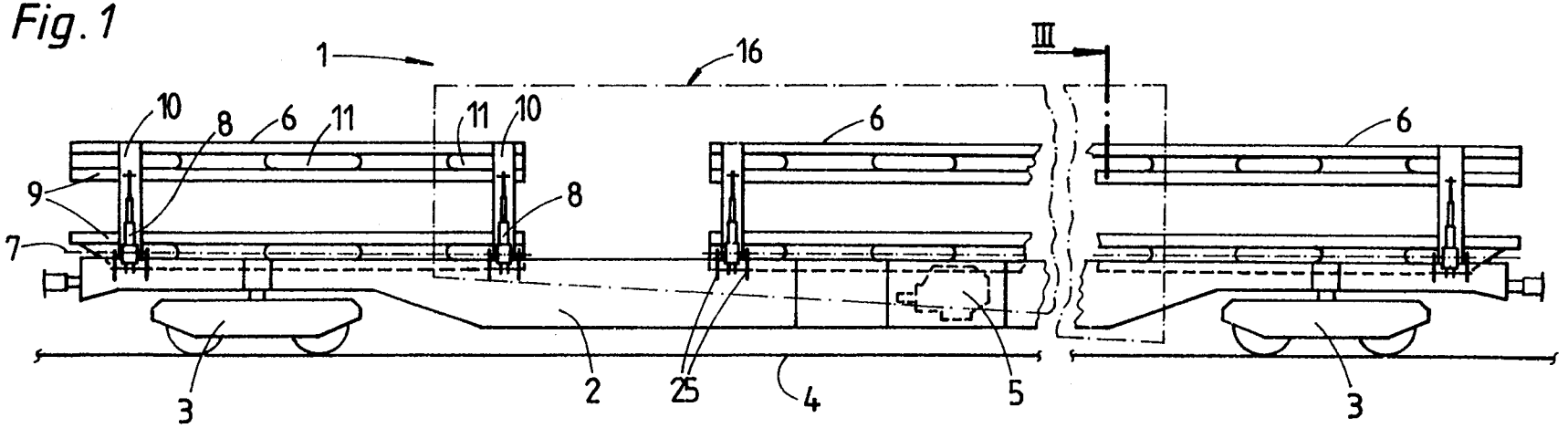
FIG. 1 is a side elevational view of a car for transporting a track switch, showing the loading platforms in their raised position and the track switch carried thereby diagrammatically indicated in phantom lines.
Figure 2:
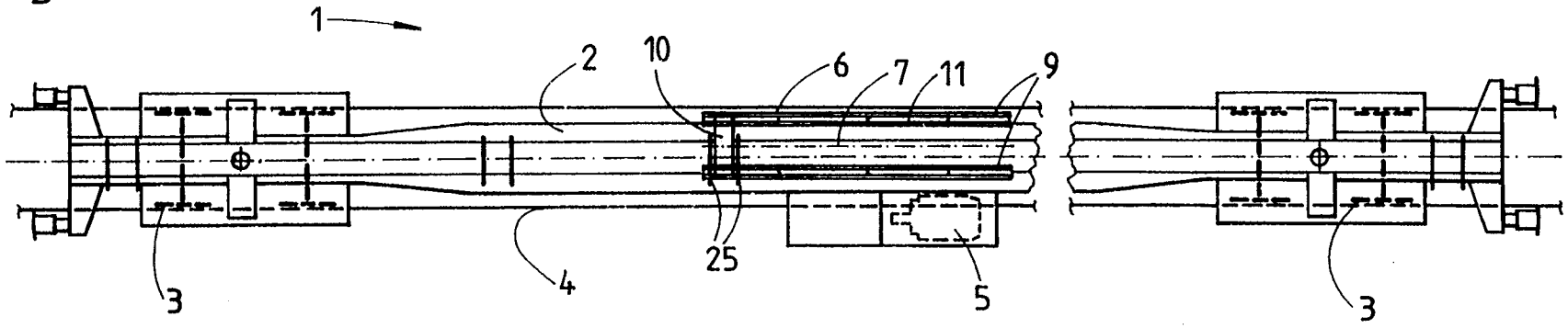
FIG. 2 is a top view of the car of FIG. 1, only one of the loading platforms being shown to make the view of the car clearer.
Figure 3:
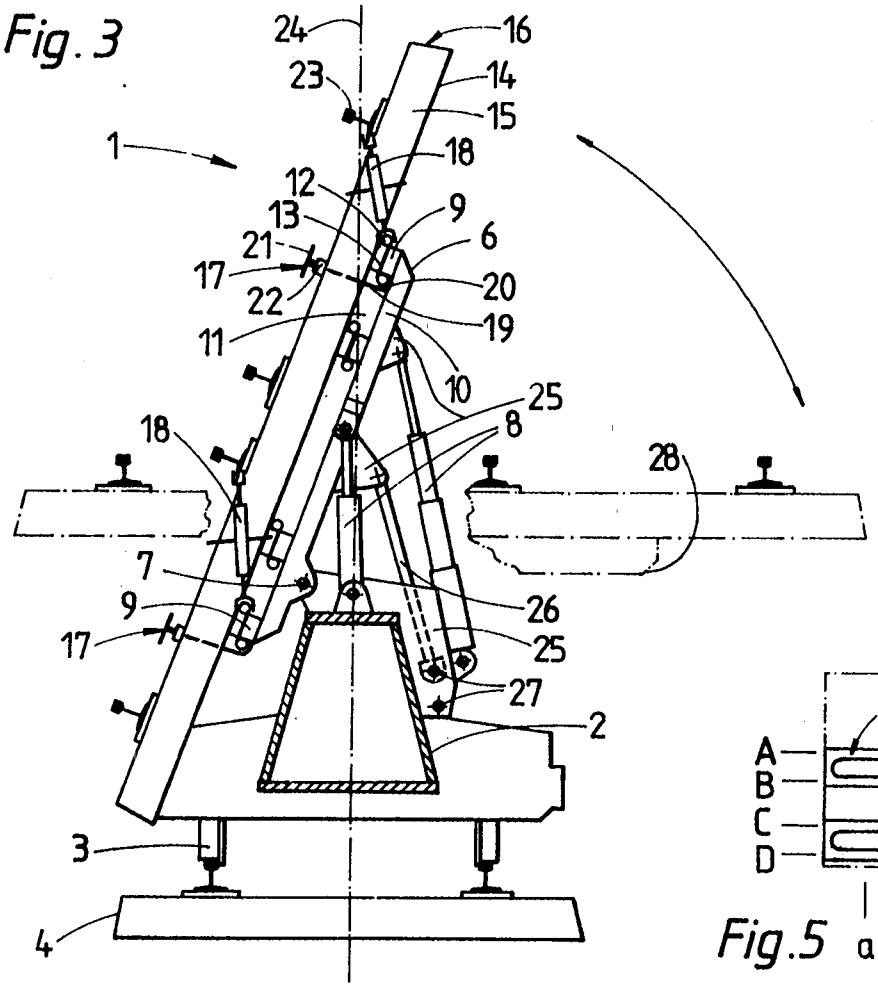
FIG. 3 is an end view taken along section line III of FIG. 1.

Referring now to the drawing and first to FIGS. 1 to 3, there is shown a car 1 for transporting a track switch 16. Car 1 comprises beam-shaped frame 2 extending in a longitudinal direction, and undercarriages 3 support the beam-shaped frame on track 4 consisting of track rails 23 fastened to ties 15 spaced apart a predetermined distance. The undercarriages have axles extending perpendicularly to the longitudinal direction and beam-shaped frame 2 is centered with respect to the axles. Energy is supplied by motor 5.

At least two, and preferably four, track switch loading platforms 6 are mounted on beam-shaped frame 2 for pivoting about axis 7 extending in the longitudinal direction, the loading platforms being spaced from each other in this direction, and two hydraulic drives 8 link each loading platform 6 to beam-shaped frame 2 for pivoting the loading platform. Track switch 16 can be detachably connected to the loading platforms for transporting the track switch.

Figure 5:
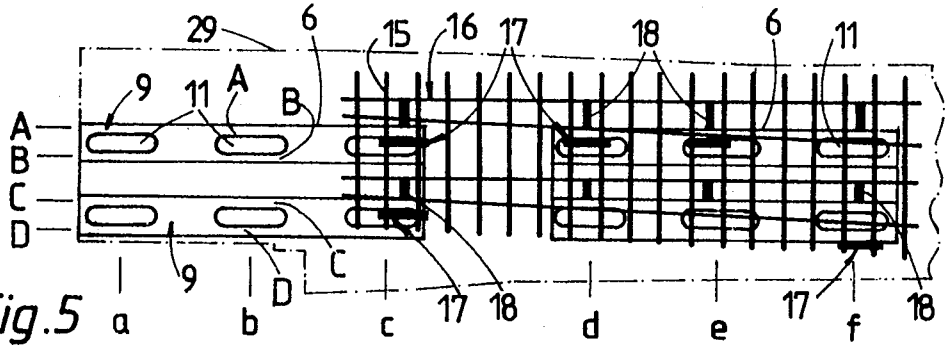
FIG. 5 is a diagrammatic view showing a portion of the car with a track switch properly positioned relative to the loading platforms.

In the illustrated embodiment, each loading platform 6 comprises two elongated carrier elements 9 extending parallel to each other and to pivoting axis 7. The carrier elements define a common plane, and two cross members 10 respectively connect the ends of carrier elements 9, the connecting members extending perpendicularly to pivoting axis 7. Each elongated carrier element 9 has two sides extending parallel to the pivoting axis and defines elongated slots 11 having two sides extending parallel thereto, the slots being centered between the sides of the elongated carrier element in a direction extending perpendicularly to the longitudinal direction, as shown in FIGS. 1 and 5.

Figure 4:
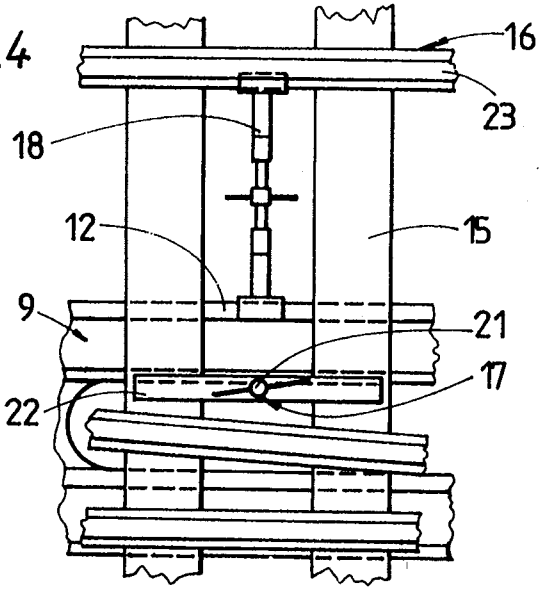
FIG. 4 is an enlarged fragmentary top view showing the means for detachably connecting the track switch to the loading platform.

Means for detachably connecting track switch 16 to loading platforms 6 comprises track switch fastening yokes 17 and holding means 13 detachably connectable thereto, the holding means being arranged along the sides of the slots and/or the sides of the elongated carrier elements. Holding means 13 are comprised of bolts 12 welded to the sides of carrier elements 9 and slots 11 (see FIG. 3). Bolts 12 extend parallel to pivoting axis 7 in a plane 14 defined by loading platform 6 and identical and co-extensive with a plane defined by the undersides of track ties 15 of track switch 16 to be transported. As also illustrated in FIG. 4, the track switch is fixed on loading platform 6 by fastening yoke 17 and support spindles 18. The fastening yoke is comprised essentially of a tie rod 19 having a free end forming hook 20 and an opposite end forming a screw thread, wing nut 21 mounted on the screw thread, and transverse yoke part 22 connected, and extending perpendicularly, to tie rod 19. The transverse yoke part has a length spanning the distance between track switch ties 15, as shown in FIG. 4. The length of support spindles 18 is adjustable, and their ends are U-shaped to enable them to grip bolts 12 and an edge of the foot of a rail 23 of the track switch, respectively.

As shown in FIG. 3, beam-shaped frame 2 defines a vertical plane of symmetry 24 extending in the longitudinal direction and pivoting axis 7 of loading platforms 6 is spaced from the plane of symmetry about 250 mm to 450 mm, preferably about 300 mm, in a direction extending perpendicularly to the longitudinal direction.

Flanges 25 project from an underside of each loading platform 6 facing beam-shaped frame 2 and a side face of the beam-shaped face. Support rods 26 have respective ends connected to the flanges, and two vertically spaced bores 27 are arranged in flange 25 projecting from the side of the beam-shaped frame for selectively attaching one of the support rod ends thereto. Support rods 26 serve to fix telescopingly extensible pivoting drives 8 in position.

The removal by car 1 of a track switch 16 from a track working site will now be described.

To receive the track switch, all loading platforms 6 are pivoted by drives 8 into a horizontal position 28 indicated in phantom lines in FIG. 3. By crane or any other suitable and conventional device, track switch 16 is placed on the horizontally positioned loading platforms and this conventional device is removed. The positioning of the track switch on the loading platforms is effected according to the positioning plan schematically illustrated in FIG. 5 and described hereinbelow.

Circumference 29 within which track switch 16 is placed on loading platforms 6 is shown in FIG. 5 in phantom lines and is derived from the known track and car geometry as well as the dimension of the track profile available for the transport of the track switch by car 1, i.e. the switch must not project laterally into the area of an adjacent track. Track switch 16 is so positioned on the loading platforms that tie rods 19 of fastening yokes 17 may pass without hindrance between track ties 15 in the region of elongated slots 11 of loading platforms 6 (as shown in FIG. 4). Support spindles 18 must similarly be optimally positioned for engagement with bolts 12 and rails 23. The distance of marked points on track switch 16 from marked points of car 1 is determined, and this distance is used to control the operation of the crane or other conventional device for rapidly and optimally placing the track switch on the loading platforms.

The following plan will facilitate a secure and rapid attachment of track switch 16 to loading platforms 6 and is schematically shown in FIG. 5. The figure illustrates support sections A, B and C, D respectively associated with each slot 11 at each side thereof. Slots 11 are sequentially arrayed from one end of car 1 to the opposite end, and are indicated by small letters a, b, c, d, e, f, etc. The following Table shows support sections A, B, C and D at the sides of slots 11, where fastening yokes 17 (+) and support spindles 18 (−) are to be provided:

TABLE

| Slots: | a | b | c | d | e | f | g | ... |
|---|---|---|---|---|---|---|---|---|
| Support section A: | | | +− | +− | +− | − | | |
| Support section B: | | | | | | | | |
| Support section C: | | | +− | − | − | − | | |
| Support section D: | | | | | | + | | |

An optimal arrangement of fastening yokes 17 and support spindles 18 may be rapidly effectuated on the basis of this plan for the attachment of track switch 16 to loading platforms 6 within circumference 29. After the track switch has been affixed to the loading platforms, hydraulic pivoting drives 8 are actuated to raise the track switch from its horizontal position (shown in phantom lines in FIG. 3) to its oblique position (shown in full lines in FIG. 3), in which it encloses an angle of 71° with the horizontal. To secure loading platforms 6 in their raised position, support rods 26 are engaged in bores 27. If the angle of the loading platforms must be changed during the transport of the track switch because of a narrowing of the passage along the track, support rods 26 may be detached, the loading platforms are pivoted to assume a desired angle, and the support rods are then attached again by engagement with the bores 27 which are vertically spaced from the bores which had been originally engaged.

What is claimed is:

1. A car for transporting a track switch having a length extending in a longitudinal direction, which comprises (a) a beam-shaped frame extending in the longitudinal direction, (b) undercarriages supporting the beam-shaped frame on track rails, (1) the undercarriages having axles extending perpendicularly to the longitudinal direction and (2) the beam-shaped frame being centered with respect to the axles, (c) at least two track switch loading platforms mounted on the beam-shaped frame for pivoting about an axis extending in the longitudinal direction, the loading platforms being spaced from each other in said direction and extending over a length corresponding substantially to the length of the track switch, whereby platform stress due to asymmetrical mass distribution of the switch is reduced, (d) at least two drives linking each loading platform to the beam-shaped frame for pivoting each loading platform, and (e) means for detachably connecting a track switch to the loading platforms for transporting the track switch.

2. The car of claim 1, comprising four of said track switch loading platforms.

3. The car of claim 1, wherein each loading platform comprises at least two elongated carrier elements extending parallel to each other and to the pivoting axis, the carrier elements defining a common plane, and two members respectively connecting the ends of the carrier elements, the connecting members extending perpendicularly to the pivoting axis.

4. The car of claim 3, wherein each elongated carrier element has two sides extending parallel to the pivoting axis and defines elongated slots having two sides extending parallel thereto, the slots being centered between the sides of the elongated carrier element in a direction extending perpendicularly to the longitudinal direction.

5. A car for transporting a track switch having a length extending in a longitudinal direction, which comprises (a) a beam-shaped frame extending in the longitudinal direction, (b) undercarriages supporting the beam-shaped frame on track rails, (1) the undercarriages having axles extending perpendicularly to the longitudinal direction and (2) the beam-shaped frame being centered with respect to the axles, (c) at least two track switch loading platforms mounted on the beam-shaped frame for pivoting about an axis extending in the longitudinal direction, the loading platforms being spaced from each other in said direction and extending over a length corresponding substantially to the length of the track switch, and each loading platform comprising (1) at least two elongated carrier elements extending parallel to each other and to the pivoting axis, the carrier elements defining a common plane and each carrier element having two sides extending parallel to the pivoting axis and defining elongated slots having two sides extending parallel thereto, the slots being centered between the sides of the elongated carrier element in a direction extending perpendicularly to the longitudinal direction, and (2) two members respectively connecting the ends of the carrier elements, the connecting members extending perpendicularly to the pivoting axis, (d) at least two drives linking each loading platform to the beam-shaped frame for pivoting each loading platform, and (e) means for detachably connecting the track switch to the loading platforms for transporting the track switch, the track switch connecting means comprising (1) track switch fastening yokes and (2) holding means detachably connectable thereto, the holding means being arranged along the sides of the slots.

6. A car for transporting a track switch having a length extending in a longitudinal direction, which comprises (a) a beam-shaped frame extending in the longitudinal direction, (b) undercarriages supporting the beam-shaped frame on track rails, (1) the undercarriages having axles extending perpendicularly to the longitudinal direction and (2) the beam-shaped frame being centered with respect to the axles, (c) at least two track switch loading platforms mounted on the beam-shaped frame for pivoting about an axis extending in the longitudinal direction, the loading platforms being spaced from each other in said direction and extending over a length corresponding substantially to the length of the track switch, and each loading platform comprising (1) at least two elongated carrier elements extending parallel to each other and to the pivoting axis, the carrier elements defining a common plane and each carrier element having two sides extending parallel to the pivoting axis and defining elongated slots having two sides extending parallel thereto, the slots being centered between the sides of the elongated carrier element in a direction extending perpendicularly to the longitudinal direction, and (2) two members respectively connecting the ends of the carrier elements, the connecting members extending perpendicularly to the pivoting axis, (d) at least two drives linking each loading platform to the beam-shaped frame for pivoting each loading platform, and (e) means for detachably connecting the track switch to the loading platforms for transporting the track switch, the track switch connecting means comprising (1) track switch fastening yokes and (2) holding means detachably connectable thereto, the holding means being arranged along the sides of the elongated carrier elements.

7. The car of claim 6, wherein the fastening yoke is comprised essentially of a tie rod having a free end forming a hook and an opposite end forming a screw thread, a wing nut mounted on the screw thread, and a transverse yoke part extending perpendicularly to the tie rod and having a length spanning a predetermined distance between ties to which rails of a track switch to be transported by the car are fastened.

8. A car for transporting a track switch having a length extending in a longitudinal direction, which comprises (a) a beam-shaped frame extending in the longitudinal direction, (b) undercarriages supporting the beam-shaped frame on track rails, (1) the undercarriages having axles extending perpendicularly to the longitudinal direction and (2) the beam-shaped frame being centered with respect to the axles, (c) at least two track switch loading platforms mounted on the beam-shaped frame for pivoting about an axis extending in the longitudinal direction, the loading platforms being spaced from each other in said direction and extending over a length corresponding substantially to the length of the track switch, (1) flanges projecting from an underside of each loading platform facing the beam-shaped frame and a side face of the beam-shaped frame, (2) support rods having respective ends connected to the flanges, and (3) two vertically spaced bores arranged in the flanges projecting from the side face of the beam-shaped frame for selectively attaching one of the ends of the support rods thereto, (d) at least two drives linking each loading platform to the beam-shaped frame for pivoting each loading platform, and (e) means for detachably connecting a track switch to the loading platforms for transporting the track switch.

* * * * *